US007427722B2

(12) United States Patent
Wu

(10) Patent No.: US 7,427,722 B2
(45) Date of Patent: Sep. 23, 2008

(54) POWER HAND TOOL

(75) Inventor: Fu-Tsai Wu, Taichung County (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 0 days.

(21) Appl. No.: 11/797,787

(22) Filed: May 8, 2007

(65) Prior Publication Data

US 2007/0278074 A1 Dec. 6, 2007

(30) Foreign Application Priority Data

Jun. 5, 2006 (TW) ..... 95209769 U

(51) Int. Cl.
*H01H 9/30* (2006.01)

(52) U.S. Cl. ..... 200/11 DA; 200/336; 200/564; 409/181; 318/268

(58) Field of Classification Search ..... 200/11 DA, 200/11 TC, 11 TW, 11 R, 179, 17 R, 336, 200/522, 564–566; 409/181–192, 178, 183–185, 409/204, 210; 173/168–170; 318/280, 268, 318/293

See application file for complete search history.

(56) References Cited

U.S. PATENT DOCUMENTS

| | | | | |
|---|---|---|---|---|
| 4,033,077 | A * | 7/1977 | Chester et al. | 451/359 |
| 5,414,793 | A * | 5/1995 | Morikawa | 388/824 |
| 6,538,218 | B2 * | 3/2003 | Bascom et al. | 200/43.17 |
| 6,940,033 | B1 * | 9/2005 | Jones et al. | 200/522 |
| 2003/0206779 | A1 * | 11/2003 | Kopras et al. | 409/182 |

* cited by examiner

*Primary Examiner*—K. Richard Lee
(74) *Attorney, Agent, or Firm*—Bacon & Thomas, PLLC

(57) ABSTRACT

A power hand tool includes a rotary adjustment knob for adjusting maximum output torque, which has a plurality of radial ribs, radial locating grooves alternatively arranged on the inner sidewall thereof, and a locating member for supporting the rotary adjustment knob in position, which has a mounting base coupled to a part inside the housing of the power hand tool and two locating portions located at two opposite sides of the mounting base. Each of the locating portions has a protrusion engaged with one of the radial locating grooves of the rotary adjustment knob.

1 Claim, 3 Drawing Sheets

POWER HAND TOOL

BACKGROUND OF THE INVENTION

1. Field of the Invention

The present invention relates to power hand tools, and more particularly to a power hand tool, which allows smooth adjustment of the rotary adjustment knob.

2. Description of the Related Art

A conventional power hand tool with output torque control function, such as a power screwdriver, usually has a circular rotary knob rotatably mounted to the housing thereof for setting the maximum output torque.

In order to set the rotary knob in the adjusted position, the rotary knob has a plurality of positioning grooves on the inner sidewall, and two positioning tongues are set between the rotary knob and the housing of the housing or a component part inside the housing. Each of the two locating tongues has a protruding portion engaged in the positioning grooves of the rotary knob. When turning the rotary knob to adjust the maximum output torque, the user must apply a sufficient force to the rotary knob to overcome the rotary force of the locating tongues.

Because the protruding portions of the locating tongues are selectively engaged into the positioning grooves of the rotary knob in radial direction, it requires many efforts to turn the rotary knob. Further, because the two locating tongues are positioned at two different locations, the installation of the locating tongues is not easy.

SUMMARY OF THE INVENTION

The present invention has been accomplished under the circumstances in view. It is therefore one object of the present invention to provide a power hand tool, which is easy to install. It is another object of the present invention to provide a power hand tool, which allows smooth adjustment of the rotary to set the maximum output torque.

To achieve the foregoing objects of the present invention, the power hand tool is composed of a housing, a motor, a battery pack, a switch, a speed change and torque control mechanism, a rotary adjustment knob, and a locating member.

The rotary adjustment knob is rotatably mounted in the housing, having a body and a top. The top has a circular opening, a plurality of radial ribs around the circular opening, and a plurality of radial locating grooves respectively formed between each two adjacent radial ribs. The body has a plurality of axially extending coupling ribs in engagement with peripheral coupling notches of the turntable of the speed change and torque control mechanism such that rotating the rotary adjustment knob causes rotation of the turntable relative to the holder member of the accommodation device. The locating member is a metallic plate made by stamping, having a mounting base coupled to the holder member of the accommodation device of the speed change and torque control mechanism, and two locating portions located at two opposite sides of the mounting base. The locating portions each have a protrusion engaged with one of the radial locating grooves of the rotary adjustment knob.

DETAILED DESCRIPTION OF THE INVENTION

Figure 1:
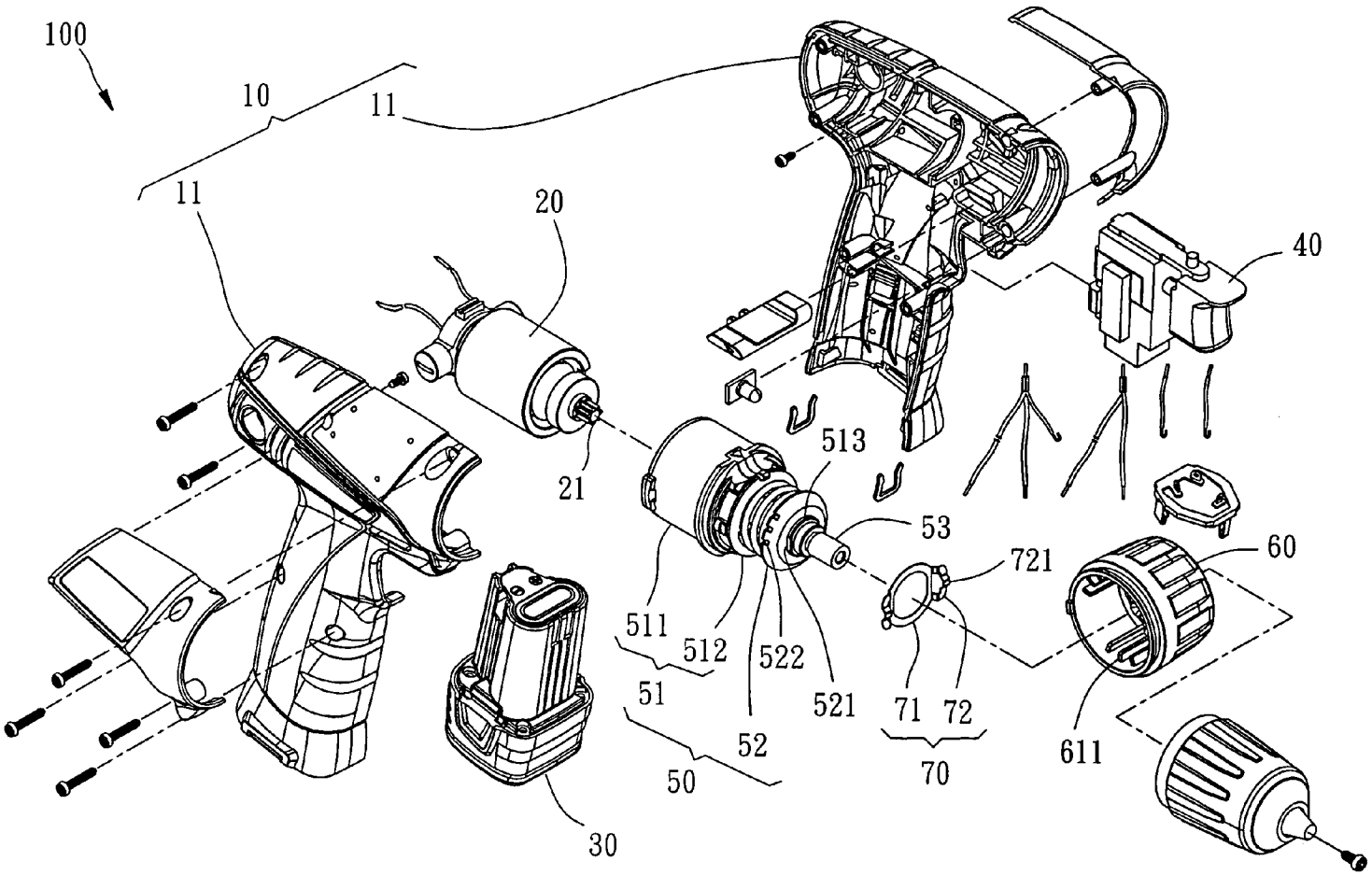
FIG. 1 is an exploded view of the power hand tool according to the present invention.
Figure 2:
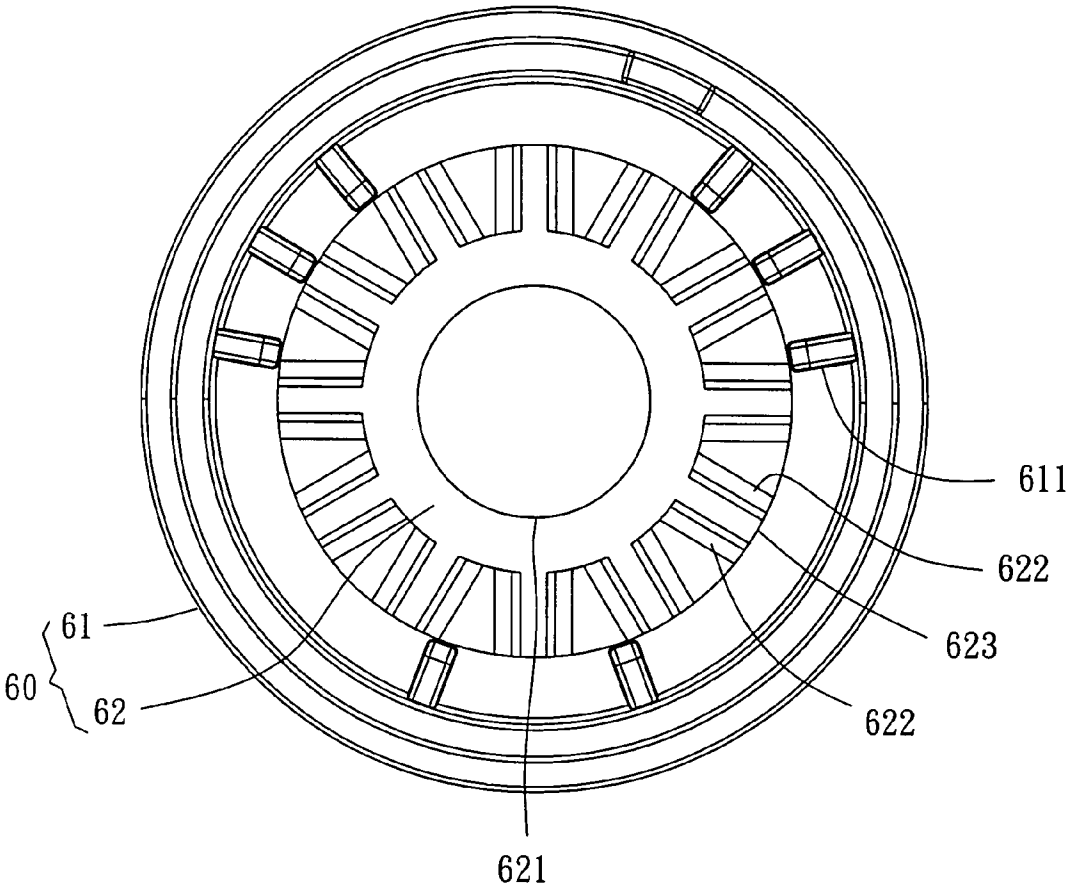
FIG. 2 is a front view of the rotary knob of the power hand tool according to the present invention.
Figure 3:
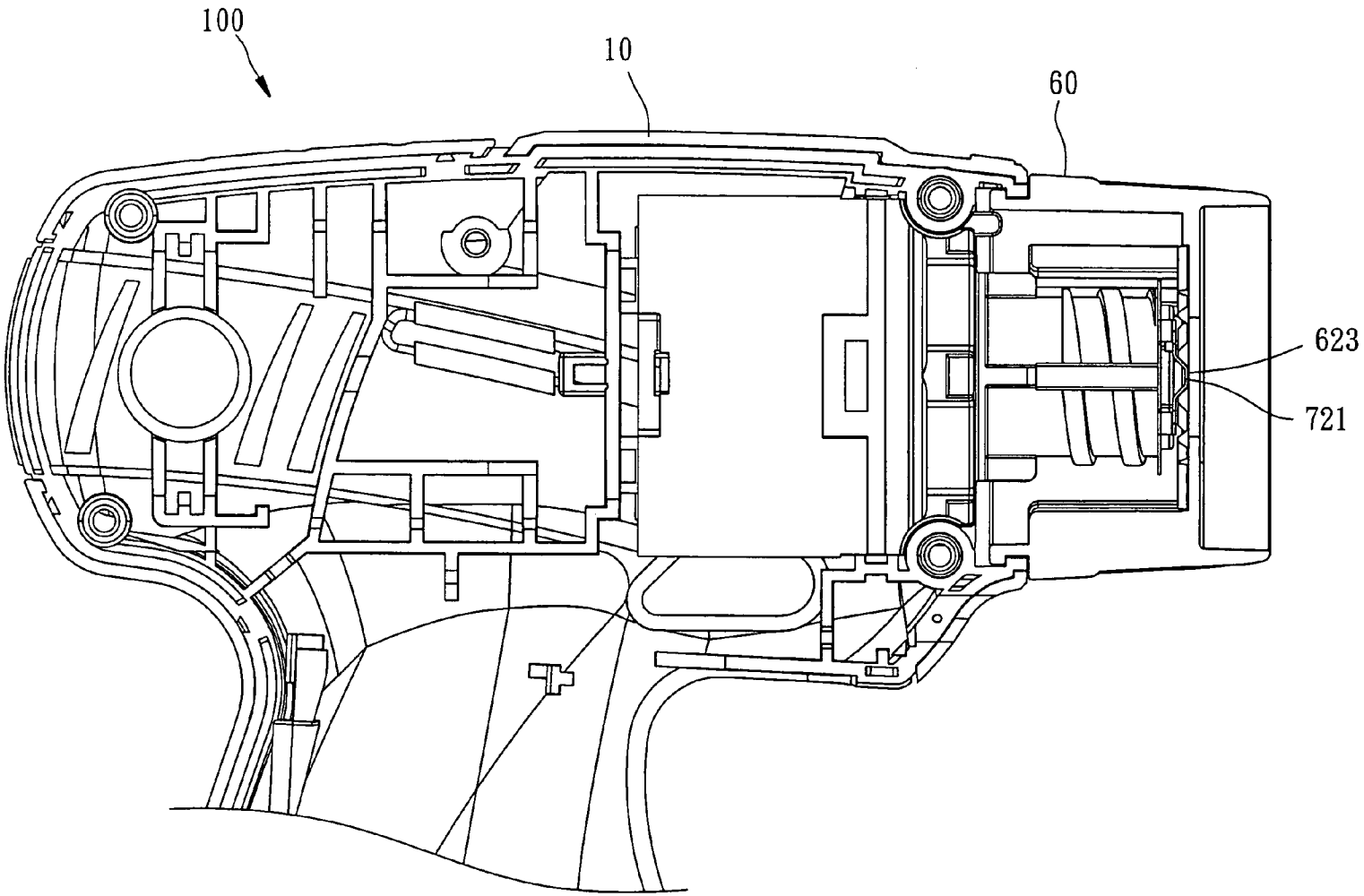
FIG. 3 is a sectional side view of the power hand tool according to the present invention.

Referring to FIGS. 1-3, a power hand tool 100 in accordance with the present invention is shown included of a housing 10, a motor 20, a battery pack 30, a switch 40, a speed change and torque control mechanism 50, a rotary adjustment knob 60, and a locating member 70.

The housing 10 is composed of two half shells 11.

The motor 20 is detachably mounted inside the housing 10, having a pinion 21 mounted to its output shaft.

The battery pack 30 is detachably mounted in the housing 10 for providing the motor 20 with electricity.

The switch 40 is fixedly mounted to the housing 10 and is electrically connected with the battery pack 30 and the motor 20 respectively for switching on/off the electrical connection between the battery pack 30 and the motor 20.

The speed change and torque control mechanism 50 is mounted inside the housing 10, having an accommodation device 51, a planet gear set (not shown), and a turntable 52. The accommodation device 51 includes a barrel 511 and a holder member 512 axially connected to one end of the barrel 511. The holder member 512 has an outer thread (513) formed along an outer periphery thereof. The planet gear set is mounted in the holder member 512 and connected to the pinion 21 of the motor 20, having an output shaft 53 that extends out of the holder member 512. The turntable 52 has a center through hole 521, and an inner thread (not shown) formed along a peripheral sidewall of the center through hole 521 and threaded with the outer thread (513) of the holder member 512. Rotating the turntable 52 causes axial movement of the turntable 52 relative to the holder member 512, thereby adjusting the maximum output torque of the power hand tool 100. Further, the turntable 52 has a plurality of coupling notches 522 disposed around a peripheral edge thereof.

The rotary adjustment knob 60 is shaped like a round cap, having a body 61 and a top 62. The top 62 has a circular opening 62 (see FIG. 2). The body 61 has a plurality of axially extending coupling ribs 611 arranged around an inner sidewall thereof. The top 62 further has a plurality of radial ribs 622 on an inner sidewall (bottom side), and a plurality of radial locating grooves 623 respectively formed between each two adjacent radial ribs 622. The rotary adjustment knob 60 is rotatably mounted to the housing 10, keeping the coupling ribs 611 in engagement with the coupling notches 522 of the turntable 52. Therefore, rotating the rotary adjustment knob 60 causes rotation of the turntable 52 relative to the holder member 512 of the accommodation device 51.

The locating member 70 is a metallic plate made by stamping, having a mounting base 71 coupled to the holder member 512 of the accommodation device 51, and two locating portions 72 located at two opposite sides of the mounting base 71. The locating portions 72 each have a protrusion 721 engaged with one of the radial locating grooves 623 of the rotary adjustment knob 60 (see FIG. 3).

By means of the design of one single locating member, the invention eliminates the installation drawback of the locating spring plates of the aforesaid prior art design. Further, because the protrusions of the locating portions are engaged in the radial locating groove of the rotary adjustment knob in axial direction relative to the rotary adjustment knob, the rotary adjustment knob can be rotated smoothly with less effort.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A power hand tool including:

a housing;

an electric motor mounted inside said housing, said motor having an output shaft, and a pinion fixedly located at said output shaft;

a battery pack detachably mounted to said housing;

a switch fixedly mounted to said housing and electrically connected to said battery pack and said motor respectively for switching on/off the electrical connection between said battery pack and said motor;

a speed change and torque control mechanism mounted inside said housing, said speed change and torque control mechanism having an accommodation device, a planet gear set, and a turntable, said accommodation device having a barrel and a holder member axially connected to one end of said barrel, said holder member having an outer thread formed along an outer periphery thereof, said planet gear set being mounted in said holder member and connected to said pinion of said motor, said planet gear set having an output shaft extending out of said holder member, said turntable having a through hole formed at a center thereof, a plurality of coupling notches formed along an peripheral edge thereof, and an inner thread located inside said through hole and threaded with the outer thread of said holder member;

a rotary adjustment knob rotatably mounted in said housing, said rotary adjustment knob having a body and a top, said top having a circular opening, a plurality of radial ribs around said circular opening, and a plurality of radial locating grooves respectively formed between each two adjacent radial ribs, said body having a plurality of axially extending coupling ribs in engagement with said coupling notches of said turntable, whereby rotating said rotary adjustment knob causes rotation of said turntable relative to said holder member of said accommodation device; and a locating member made of a metallic plate by stamping, said locating member having a mounting base coupled to said holder member of said accommodation device, two locating portions located at two opposite sides of said mounting base, two protrusions formed on said two locating portions respectively for stopping against said radial locating grooves of said rotary adjustment knob respectively.

* * * * *